US008789778B2

(12) United States Patent
Abeln

(10) Patent No.: US 8,789,778 B2
(45) Date of Patent: Jul. 29, 2014

(54) CUTTING DEVICE

(75) Inventor: Michael Abeln, Emstek (DE)

(73) Assignee: Hugo Vogelsang Maschinenbau GmbH, Essen (DE)

( * ) Notice: Subject to any disclaimer, the term of this patent is extended or adjusted under 35 U.S.C. 154(b) by 217 days.

(21) Appl. No.: 13/260,385

(22) PCT Filed: Mar. 24, 2010

(86) PCT No.: PCT/EP2010/053800
§ 371 (c)(1),
(2), (4) Date: Nov. 17, 2011

(87) PCT Pub. No.: WO2010/108932
PCT Pub. Date: Sep. 30, 2010

(65) Prior Publication Data

US 2012/0091243 A1 Apr. 19, 2012

(30) Foreign Application Priority Data

Mar. 25, 2009 (DE) ..... 20 2009 003 995 U

(51) Int. Cl.
*B02C 23/36* (2006.01)

(52) U.S. Cl.
USPC ..... 241/46.06; 241/69; 241/258

(58) Field of Classification Search
USPC ..... 241/21, 46.017, 46.06, 69, 277, 282.1, 241/282.2, 257.1, 258
See application file for complete search history.

(56) References Cited

FOREIGN PATENT DOCUMENTS

| | | |
|---|---|---|
| DE | 1584970 | 2/1970 |
| DE | 19700183 | 7/1997 |
| DE | 29910596 | 9/1999 |
| DE | 20217550 | 10/2003 |
| DE | 202005010617 | 11/2006 |
| DE | 202006014804 | 9/2007 |

*Primary Examiner* — Mark Rosenbaum
(74) *Attorney, Agent, or Firm* — Kilpatrick Townsend & Stockton LLP; Dean W. Russell, Esq.

(57) ABSTRACT

The invention relates to a cutting device for macerating a free-flowing fluid-solid mixture, having a knife rotor which is mounted in such a manner as to be able to rotate relative to a cutting sieve. Said knife rotor abuts the cutting sieve axially with respect to the direction of its axis of rotation, and is pretensioned against the cutting sieve in the axial dimension. According to the invention, at least one clearance space is included, wherein the same is bounded by at least one first and one second surface, and the first surface is arranged in a manner such that it cannot be displaced in the axial dimension toward the knife rotor, the second surface is arranged in a manner such that it cannot be displaced in the axial dimension toward the cutting sieve, and the first and the second surfaces are arranged such that they cannot rotate about the axis of rotation of the knife rotor with respect to each other. At least one freewheel body is arranged in the at least one clearance space, and is pretensioned in the axial dimension to abut the first and the second surface in a second pretensioning direction, and the first and the second surfaces are designed at least partially in such a manner that the radial gap between the first and the second surface narrows in the direction of the second pretensioning direction, whereby a relative movement in the axial dimension between the knife rotor and the cutting sieve in the direction opposite that of the first pretensioning direction is prevented.

15 Claims, 2 Drawing Sheets

CUTTING DEVICE

CROSS REFERENCE TO RELATED APPLICATIONS

This application is the U.S. national phase of International Application No. PCT/EP2010/053800 filed on Mar. 24, 2010, which application claims priority to German Patent Application No. 20 2009 003 995.1 filed on Mar. 25, 2009, the contents of both of which are incorporated herein by reference.

The invention relates to a cutting device for macerating a free-flowing fluid-solid mixture, having a knife rotor which is mounted in such a manner as to be able to rotate relative to a cutting sieve. Said knife rotor abuts the cutting sieve axially with respect to the direction of its axis of rotation, and is pretensioned against the cutting sieve in the axial dimension.

Fluid-solid mixtures which are capable of flow include media, liquids, or suspensions, for example, which carry coarse, solid, floating, or suspended particulate matter such as fibers, textiles, bones, pieces of wood, hair, roping, or grass.

Cutting devices of the type named above, which are also called macerators or wet macerators, are used for reducing, homogenizing, and dispersing fluid-solid mixtures which are capable of flow. They are used in sewage treatment plants, for example, in order to make sewage sludge containing a high fraction of solids free-flowing. In addition, they are also used in biogas plants, for example, for reducing and mixing waste water, sewage, wastes, and manure, for example, as well as for reducing food wastes and/or animal cadaver parts, for example in plants which process animal bodies or manufacture animal feed, for reducing particles of paint and paint resides in the paint industry, for reducing and mixing solids in media as part of the production of cleaning agents and glues, for example, in the chemical industry, or for reducing fish and fish wastes as part of the production of fish meal. A defined reduction of the solids is also of particular importance in the waste disposal industry, for example.

A perforated plate or a screen plate, for example, preferably made of steel, is used as the cutting sieve. The knife rotor abuts the cutting sieve in the axial dimension, such that when the knife rotor is rotated, the solids are macerated between the knife rotor and the cutting sieve. For this purpose, the knife rotor is pretensioned against the cutting sieve in the axial direction.

DE 299 10 596 U1 shows a pretensioning device for pretensioning a cutting member and/or a knife rotor onto an intake screen mesh and/or a cutting sieve, having a pressing member designed as a piston, wherein pressure can be applied to the pressure chamber of the pressing member by means of a suitable pressure medium, and the pressing force of the cutting member on the intake screen mesh corresponds to the force exerted by the piston. DE 20 2005 010 617 U1 discloses a pretensioning device, wherein the knife rotor is set in its work position by means of a part which generates axial pressure. In addition, in the case of this solution, the shaft which drives the knife rotor is sealed in a piston which receives the drive motor, and the piston is arranged an [sic] a pressurizing medium cylinder, wherein the pressurizing medium thereof pretensions the knife rotor on the cutting sieve. DE 20 2006 014 804 U1 discloses a pretensioning device for a knife rotor of a cutting device, wherein the knife rotor is mounted on a pretensioning part which rotates with the knife rotor. The patent also discloses that the pretensioning part can be adjusted in a controlled manner along the axial dimension. The axial position of the pretensioning part with respect to the perforated plate or the sieve plate can be controlled by means of suitable means. The drive shaft is connected to the pretensioning part via a lower clamping nut, and in this way the base position of the knife rotor can be adjusted with respect to the perforated/sieve plate. This embodiment enables control of the axial position of the pretensioning part, and also determination of a knife rotor base position. However, the disclosed solutions can be further simplified and/or improved. In addition, the control of the pretensioning force as well as securement against lifting of the knife rotor off of the perforated plate or sieve plate can be simplified and/or improved.

DE 202 17 550 U1 discloses a knife rotor which is fixed in the working position thereof by means of a part which generates axial pressure in a self-locking function. In the case of this invention, a spring only functions as a spring in one direction, and in the opposite direction does not yield, due to the self-locking function of the part which generates axial pressure. In DE 202 17 550 U1, the part which generates axial pressure is realized as a spiral wedge with a self-locking function, or as an excenter. In this way, the invention intends to prevent a knife rotor which is pretensioned only by a spring from being able to lift off of a cutting sieve when the spring yields, resulting in no clean maceration taking place, and also resulting in the possibility of solids accumulating on the cutting sieve. However, this solution can be further simplified and/or improved with regard to the construction thereof, particularly with respect to the setting and maintenance of the pretensioning force and the securement of the device against the lifting of the knife rotor from the cutting sieve.

As such, the problem addressed by the present invention is that of mitigating or removing one or more of the disadvantages named above. In addition, a problem addressed by the present invention is that of at least partially meeting the demand for improvement named above. A further problem addressed by the present invention is that of providing an alternative solution to that disclosed in the prior art.

This problem is solved by a cutting device of the type named above, characterized by at least one clearance space which is bounded by at least one first and one second surface, wherein

- the first surface is arranged in a manner which is fixed with respect to the knife rotor in the axial dimension
- the second surface is arranged in a manner which is fixed with respect to the cutting sieve in the axial dimension,
- the first and the second surfaces are arranged in such a manner that the same cannot rotate about the axis of rotation of the knife rotor with respect to each other,
- at least one freewheel body is arranged in the at least one clearance space, and is pretensioned in the axial dimension to abut the first and the second surfaces in a second pretensioning direction, and
- the first and the second surfaces are at least partially designed in such a manner that the radial gap between the first and the second surfaces becomes narrower in the direction of the second pretensioning direction,
- whereby a relative movement in the axial dimension between the knife rotor and the cutting sieve against the first pretensioning direction is prevented.

The knife rotor preferably has a knife holder with at least one, and preferably two or more knives, wherein the same abut the cutting sieve and are pretensioned against the same. The knives are worn down over the operating life of the cutting device, such that they must be advanced against the cutting sieve. This is carried out by means of the pretensioning of the knife rotor against the cutting sieve. However, a pretensioning which is too high leads to early wear of the knives. Too little pretensioning, in contrast, can have the result that the knife rotor lifts off of the cutting sieve, i.e. no longer abuts the cutting sieve, due to an increased amount of solids or a particular type of solid, for example. In this case, it is not possible to reliably macerate the fluid-solid mixture, and solids can become deposited on the cutting sieve.

The cutting device according to the invention therefore includes a second pretensioning mechanism in a second pretensioning direction, in addition to the mechanism for pretensioning the knife rotor against the cutting sieve in a first pretensioning direction. This second pretensioning mechanism has at least one clearance space, and optionally two or more clearance spaces, in which at least one, and optionally two or more, freewheel bodies are constructed. The following embodiments each apply in an analogous manner for one, two, or more clearance spaces, and one, two, or more freewheel bodies.

The clearance space is bounded on one side thereof by a first surface which is coupled to the knife rotor in a manner which is rigid in the axial dimension. By way of example, the clearance space can be constructed on the knife rotor. On the other side thereof, the clearance space is bounded by a second surface which is coupled to the cutting sieve in a manner which is fixed in the axial dimension. This can be realized in that the cutting sieve is coupled to a drive shaft via a housing and a hollow axle and the second surface is constructed on this drive shaft, for example. Both surfaces are arranged in such a manner that they cannot rotate with respect to each other about the axis of rotation of the knife rotor.

The freewheel body is pretensioned in a second pretensioning direction in such a manner that it is pressed between the first and the second surfaces of the clearance space, wherein said pretensioning direction extends axially in the direction of the axis of rotation of the knife rotor. The pretensioning force in this case is preferably selected in such a manner that a clamping force is achieved between the first surface and the freewheel body, and the second surface and the freewheel body, and that the freewheel body is prevented from gliding on one or both of the surfaces.

Along this second pretensioning direction, the gap between the two surfaces becomes reduced, wherein said gap is a radial gap with respect to the axis of rotation of the knife rotor. The freewheel body is brought into contact with the first and the second surfaces by means of the pretension at the point of the clearance space where the radial gap between the first and the second surfaces corresponds to the circumference of the freewheel body. It is not possible to arrange the freewheel body in a section of the clearance space in which the radial gap between the first and the second surfaces is smaller than the radial circumference of the freewheel body. This prevents a relative movement between both surfaces—and therefore between the knife rotor and the cutting sieve—which would reduce the radial gap between the first and the second surfaces at the location of the clearance space at which the freewheel is situated. In this way, an efficient self-locking function is achieved by preventing a relative movement in the axial dimension between the first and the second surfaces, wherein such a movement would result in the knife rotor moving away from the cutting sieve—i.e. a relative movement between the knife rotor and the cutting sieve against the first pretensioning direction.

However, a relative movement between both surfaces, in such a manner that the radial gap between both surfaces, at the location where the freewheel body is located, becomes larger, remains possible. This means that a relative movement of the knife rotor toward the cutting sieve, meaning in the first pretensioning direction, is possible. This is particularly necessary in order to advance the knife rotor against the cutting sieve upon the knife rotor wearing down.

The cutting device according to the invention has the advantage of providing, in addition to the pretensioning of the knife rotor against the cutting sieve, a further pretensioning device which functions as a self-locking device, and is structurally simple to realize and simultaneously prevents, in a reliable manner, the knife rotor from lifting off of the cutting sieve. The cutting device according to the invention also constitutes an alternative solution for preventing the knife rotor from lifting off of the cutting sieve, wherein said solution is simpler, more efficient, and more reliable than the solutions disclosed in the prior art.

The invention can be further implemented by constructing the first surface on a holder segment of the knife rotor, wherein the holder segment is designed to connect the knife rotor to a drive shaft, preferably via a feather key, in a torsion-proof manner. In this case, the drive shaft is designed to drive the rotation of the knife rotor. The invention can be further implemented by constructing the second surface on a drive shaft.

The knife rotor is preferably connected to the drive shaft in a torsion-proof manner, and the drive shaft serves to rotate the knife rotor about its axis of rotation. The connection between the knife rotor and the drive shaft is realized according to the invention via a holder segment of the knife rotor, wherein the same is connected to the drive shaft in a torsion-proof manner, preferably via a feather key. The holder segment of the knife rotor can assume the shape of a hollow cylinder, for example.

According to this preferred implementation, the first surface, arranged in a manner which is fixed with respect to the knife rotor in the axial dimension, is constructed on the holder segment of the knife rotor. The first surface can preferably be constructed on the inner side of the hollow cylinder. In addition, the second surface is preferably constructed on a drive shaft. In this case, it is particularly preferred that the drive shaft on which the second surface is constructed is identical to the drive shaft to which the knife rotor is connected in a torsion-proof manner.

An advantageous, especially efficient construction of the cutting device according to the invention results from the implementation named above.

The invention can be further implemented by designing the first surface as the inner surface of a cone, and/or as a section of an inner surface of a cone, and/or by designing the second surface as the outer surface of a cylinder and/or as a section of an outer surface of a cylinder.

The design of the first surface as the inner surface of a cone, and the design of the second surface as the outer surface of a cylinder is particularly preferred if the clearance space is designed in the shape of a ring. The design of the first surface as a section of an inner surface of a cone, and/or the design of the second surface as a section of the outer surface of a cylinder is particularly preferred if the clearance space is designed as a section of a ring. This implementation is also preferred particularly in combination with the implementation named above, wherein the first surface is constructed on a holder segment of the knife rotor and the second surface is constructed on a drive shaft.

In this implementation, the clearance space can preferably be designed as a ring-shaped recess on the inner side of the holder segment of the knife rotor, said holder segment being mostly and preferably designed as a hollow cylinder. Also in this implementation, the clearance space has, as the first surface, preferably a conical surface which faces inward radially. This implementation further advantageously exploits the outer surface of the drive shaft, said outer surface being mostly, and at least partially shaped like a cylinder, as the second surface. This constitutes a simple and efficient construction which also prevents a relative movement between the knife rotor and the cutting sieve in the axial dimension against the first pretensioning direction, in a reliable manner.

This implementation, moreover, has the advantage that the strength of the drive shaft is not compromised by a recess. In addition, assembly, maintenance, and operational start-up can be carried out in a particularly efficient manner with this implementation.

The invention can be further implemented by a configuration wherein the second pretensioning direction lies in the same direction as the first pretensioning direction.

This implementation ensures that the freewheel body is pretensioned in the clearance space in the same axial direction in which the knife rotor is pretensioned against the cutting sieve. This implementation is particularly preferred in combination with the implementation named above, wherein the first surface is constructed as the inner surface of a cone on the holder segment of the knife rotor and the second surface is constructed as an outer surface of a cylinder on the drive shaft. This implementation is also characterized by particularly efficient assembly, maintenance, and operational start-up.

As an alternative, the invention can also be implemented by a configuration wherein the second pretensioning direction lies counter to the first pretensioning direction.

This implementation is particularly preferred if a kinematic reversal of the preferred implementation named above is selected. This is particularly the case if the first surface is constructed as the inner surface of a hollow cylinder on the holder segment of the knife rotor, and the second surface is constructed as the inner surface of a cone in a recess in the drive shaft or on the drive shaft (for example, in a sheath attached to the drive shaft).

This alternative is also characterized by a simple and efficient construction which also ensures the reliable prevention of a relative movement in the axial dimension between the knife rotor and the cutting sieve in the opposite direction from the pretensioning direction.

The difference between both alternative embodiments named above is that the pretensioning direction of the freewheel body in the second alternative implementation named extends opposed to the first pretensioning direction due to the kinematic reversal. As such, it also extends opposed to the second pretensioning direction in the first alternative implementation named. Accordingly, in the second alternative implementation, the first and the second surfaces converge in a direction which is opposed to the direction named in one of the first alternative embodiments named.

The preferred implementation named below can be combined with all implementations named above, particularly with the first and second alternative implementations named above.

The invention can be further implemented by a configuration wherein the clearance space is designed as a ring-shaped recess.

The ring-shaped, rotationally symmetric design of the clearance space is advantageous because the components of the cutting device on which the first and/or second surfaces are preferably constructed are also designed, mostly and at least partially, as rotationally symmetric. The ring-shaped, rotationally symmetric recess according to the invention can have any desired cross-section which is at least bounded by the first and the second surfaces. The ring-shaped recess can particularly be constructed on the holder segment of the knife rotor coaxially to the drive shaft. Particularly in the event that one or both surfaces are constructed on the knife rotor, e.g. on the holder segment of the knife rotor wherein said holder segment is preferably designed as a hollow cylinder, and/or are constructed on the drive shaft, it is particularly advantageous from a manufacturing point of view if the clearance space is constructed as a ring-shaped recess.

The invention can be further implemented by a configuration wherein the freewheel body is designed as a sphere.

According to the invention, the freewheel body can assume any shape which is adapted to the clearance space, including an egg shape, a cone shape, or a lens shape, by way of example. In addition, the freewheel body can be constructed as a ring or a segment of a ring, for example with a circular, oval, or lens-shaped cross-section. In addition, it is also possible to design the freewheel body as a roll, for example. However, a configuration wherein the freewheel body is designed as a sphere is particularly preferred. This preferred design of the freewheel body as a sphere has the advantage of simple manufacture along with high precision. In addition, the sphere design also has the advantage that it is possible to orient the freewheel body in any manner during assembly. No particular orientation of the freewheel body is necessary during installation of the same.

The invention can be further implemented by a configuration wherein the freewheel body is pretensioned between the first and the second surfaces by means of a pressure spring.

The pressure spring is preferably connected via a first end thereof to the freewheel body, and via a second end thereof to one end of the clearance space. This implementation according to the invention constitutes a simple, cost-effective, and reliable embodiment of the pretensioning of the freewheel body.

The invention can be further implemented by a configuration wherein the knife rotor is pretensioned against the cutting sieve in such a manner that the knife rotor abuts the cutting sieve with a substantially constant pretensioning force, wherein the pretensioning force is preferably adjustable.

When the pretension is generated between the knife rotor and the cutting sieve—for example by means of an extension spring—the travel of the spring becomes shorter due to the wear of the knifes, such that the force generated for pretensioning is reduced. A reduced pretension, however, can lead to reduced functionality of the cutting device. The implementation according to the invention therefore includes a configuration wherein the pretensioning force with which the knife rotor is pretensioned against the cutting sieve is substantially constant over the operating life of the cutting device. This is particularly true even when the knives of the knife rotor wear down.

An addition, it is preferred that the pretensioning force can be adjusted—meaning that it can be modified. This is particularly preferred in the event that the cutting device is intended for different operational purposes, wherein different fluid-solid mixtures with different amounts of solids and with different types of solids are macerated. Depending on the fluid-solid mixture, a corresponding, specific pretensioning force is required, and the same is preferably adjustable according to the invention, and remains substantially constant following adjustment.

The invention can be further implemented by a configuration wherein the pretension of the knife rotor against the cutting sieve is generated by means of one, two, or multiple extension springs, wherein the force of the spring produced by the extension spring(s) can preferably be adjusted.

The generation of the pretensioning force between the knife rotor and the cutting sieve by means of one, two, or multiple extension springs is a simple, cost-effective, and reliable construction. The spring force in this case can preferably be adjusted and/or modified. This can particularly be realized by means of a displacement of at least one attachment point of the extension spring.

It is also possible, in the case of the drive being provided particularly by a slip-on gear mechanism, and in the case of a hollow shaft being used, to transmit the pretensioning force to the knife rotor, said pretensioning force being required to pretension the knife rotor against the cutting sieve, by means of a threaded rod of springs arranged external thereto, and to adjust said pretensioning force. A hydraulic cylinder can also be used in place of the springs.

The invention can be further implemented by a configuration wherein one or more extension springs have a length which is relatively longer than the wear path traveled by the knife.

The wear of the knives can influence the length of the spring travel. In the case where, according to the invention, the possible wear of the knives is very small in comparison to the length of the extension spring(s), the wear of the knives affects the pretensioning force only in an insubstantial manner, meaning that the pretensioning force only changes minimally. As such, the implementation can ensure, in a manner which is especially structurally simple, that the pretensioning force which pretensions the knife rotor against the cutting sieve remains substantially constant, even when the knives wear down.

The invention can be further implemented by a configuration wherein the extension spring(s) is/are connected via a first end thereof to the knife rotor, and via a second end thereof to the drive shaft.

This implementation is particularly preferred in the case that the cutting sieve is connected to the drive shaft in a manner such that the cutting sieve cannot be displaced in the axial dimension, such that in this way it is possible for the knife rotor to be pretensioned against the cutting sieve in a simple manner wherein the knife rotor and the drive shaft are connected to each other via one, two, or multiple extension springs. The first end of the extension spring(s) in this case is preferably connected to the holder segment of the knife rotor.

The invention can be further implemented by a configuration wherein the at least one clearance space, and optionally one, two, or multiple extension springs for pretensioning the knife rotor against the cutting sieve, are arranged in the hollow cavity of a hollow axle.

The maceration of free-flowing fluid-solid mixtures involves a high degree of fouling. The functional capability of the clearance space according to the invention, with the freewheel body pretensioned and arranged therein, could be compromised by contamination and/or deposits. The arrangement according to the invention of the clearance space in the hollow cavity of a hollow axle prevents the fouling of the clearance space in a simple and structurally advantageous manner. In this case, the hollow cavity of the hollow axle is preferably sealed with respect to the fluid-solid mixture being macerated. In addition, it is preferred that one, two, or multiple extension springs for pretensioning the knife rotor against the cutting sieve are also arranged in the hollow cavity of the hollow axle, wherein these are preferably identical to the one, two, or multiple extension springs for pretensioning the knife rotor against the cutting sieve named above, because this/these extension spring(s) could also at least partially lose functional capability due to contamination or deposits.

In addition, the drive shaft is preferably mounted in the hollow axle such that the drive shaft can rotate. In this way, the arrangement of the at least one clearance space according to the invention, and advantageously the arrangement of the one, two, or multiple extension springs for pretensioning the knife rotor against the cutting sieve inside the hollow space of this hollow axle, do not require, or require only little additional structural complexity.

The invention can be further implemented by a configuration wherein the pretensioning of the freewheel body used to bring the same into contact with the first and the second surfaces can be reversed. This is particularly preferred in the event that it is desirable to lift the knife rotor off of the cutting sieve—for example when exchanging knives in the knife rotor.

The invention can be further implemented by a configuration wherein

- a holder segment of the knife rotor is connected in a torsion-proof manner to a drive shaft via a feather key, wherein the drive shaft is mounted in a fixed hollow axle which cannot be displaced in the axial dimension and which is coupled to the cutting sieve, the drive shaft being mounted thereto in a rotatable manner and in a manner such that the same cannot be displaced in the axial dimension, and the drive shaft is designed to drive the rotation of the knife rotor,
- the clearance space is designed as a ring-shaped recess in the holder segment of the knife rotor which is coaxial with the drive shaft, wherein the first surface is constructed as the inner surface of a cone on the holder segment of the knife rotor and the second surface is constructed as an outer surface of the drive shaft,
- the axial gap between the first and the second surfaces becomes narrower in the direction approaching the cutting sieve,
- the at least one freewheel body is pretensioned by means of at least one pressure spring,
- the knife rotor is pretensioned against the cutting sieve by at least one, two, or multiple extension springs,
- the clearance space, the extension springs, and at least one segment of the drive shaft are arranged in the hollow space of the hollow axle, and
- the extension spring(s) has/have a relatively large length with respect to a wear path traveled by the knife rotor.

This implementation combines particularly preferred features of the present invention in an advantageous manner, and is characterized by an especially efficient construction which—on the one hand—reliably ensures a substantially constant pretensioning of the knife rotor against the cutting sieve, even as the wear of the knives increases, and—on the other hand—prevents the knife rotor from lifting off of the cutting sieve in an equally reliable manner. At the same time, the implementation according to the invention is simple to manufacture, and has a long expected operating life. This is because the implementation prevents contamination of the clearance space and the extension spring(s) by means of the arrangement of the same in the hollow axle, for example.

Additional advantageous embodiment variants of the device according to the invention result from the combination of the features in the implementations described above.

One preferred embodiment of the invention is explained below with reference to the attached figures, wherein:

FIG. 1 shows a cutting device 1 according to the invention, in a cross-sectional view. The pretensioning of the knife rotor against the cutting sieve, and the pretensioning device for preventing the knife rotor from lifting off of the cutting sieve, are both illustrated in enlargement in Detail I in FIG. 2.

A freeflowing fluid-solid mixture enters the cutting device 1 via an inlet opening 531, passes through the cutting device in a channel 800, and leaves the cutting device 1 through the outlet opening 522 after maceration.

Figure 1:
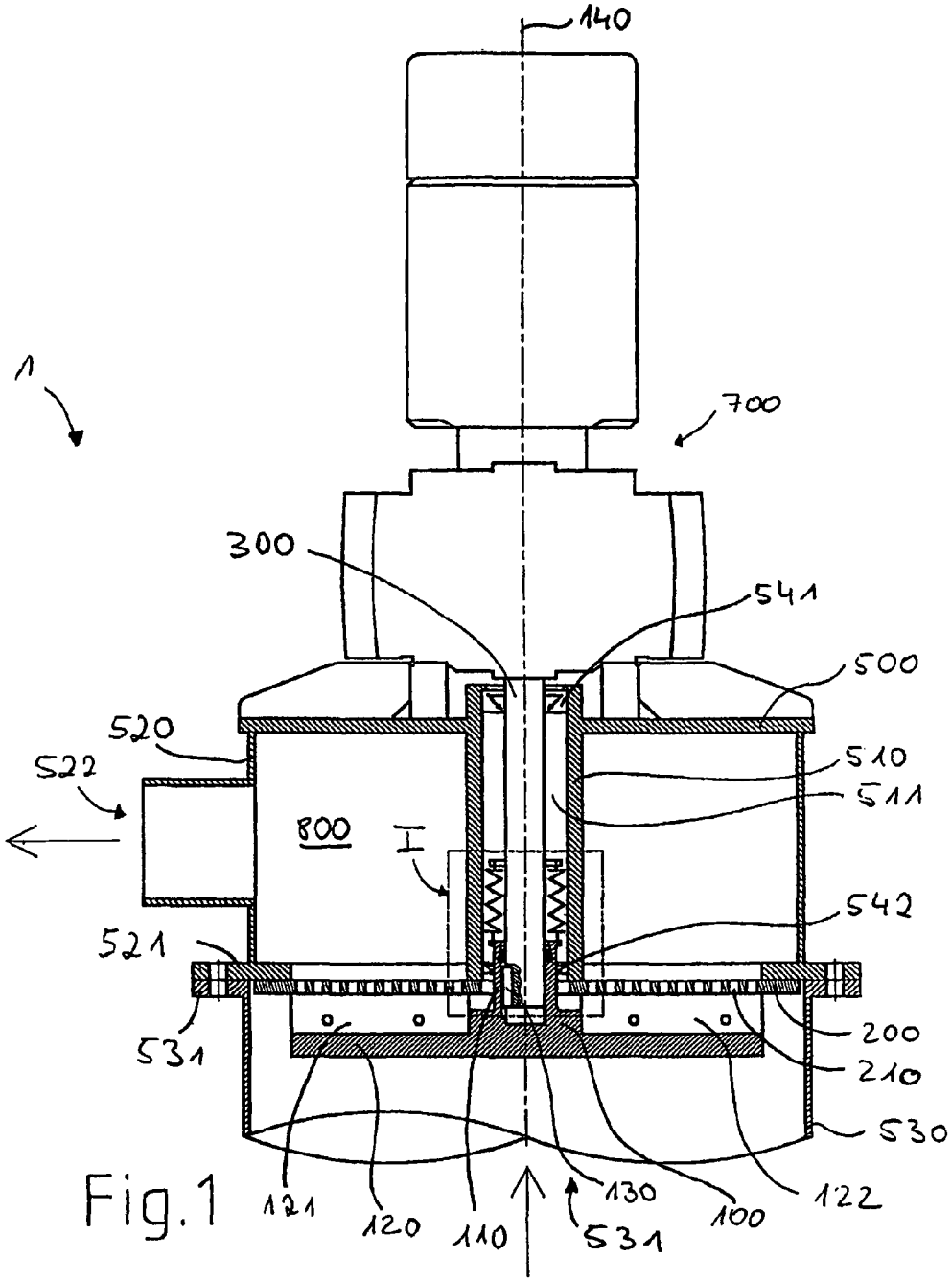
FIG. 1 shows a cross-section through a cutting device according to the invention.

The cutting device 1 has a knife rotor 100 which has a holder segment 110, a knife holder 120, and multiple knives. Of the latter, two knives 121, 122 can be seen in the illustration shown in FIG. 1.

The knives 121, 122 abut a cutting sieve 200. The cutting sieve 200 has multiple openings 210, and the macerated fluid-solid mixture passes through these openings 210.

The knife rotor 100 is connected via the holder segment 110 to a drive shaft 300 in a torsion-proof manner by means of a feather key 130. The drive shaft 300 is driven by a motor 700.

The drive shaft 300 is mounted in a hollow axle 510 in a rotatable manner. The hollow axle 510 is connected to a housing 500. The housing 500 has a housing wall 520 with a connection flange 521 and an outlet opening 522. The cutting sieve 200 is rigidly connected to the housing 500 via the connection flange 521. In addition, the housing segment 530 is rigidly connected via a connection flange 531 to the connection flange 521.

The knife rotor 100, cutting sieve 200, and hollow axle 500 are constructed as substantially rotationally symmetric about the axis of rotation 140 of the knife rotor, excluding perhaps the recess for the feather key 130.

The hollow axle 510 has a hollow cavity 511 which is sealed with respect to the channel 800 for the fluid-solid mixture by means of shaft seal rings 541 and 542.

The hollow axle 510, the housing 500, and the cutting sieve 200 are rigidly connected to each other. The drive shaft 300 is connected to the hollow axle 510 in a manner such that it cannot be displaced in the axial dimension, and therefore is also connected via the housing 500 to the cutting sieve 200 in a manner such that it cannot be displaced in the axial dimension.

Figure 2:
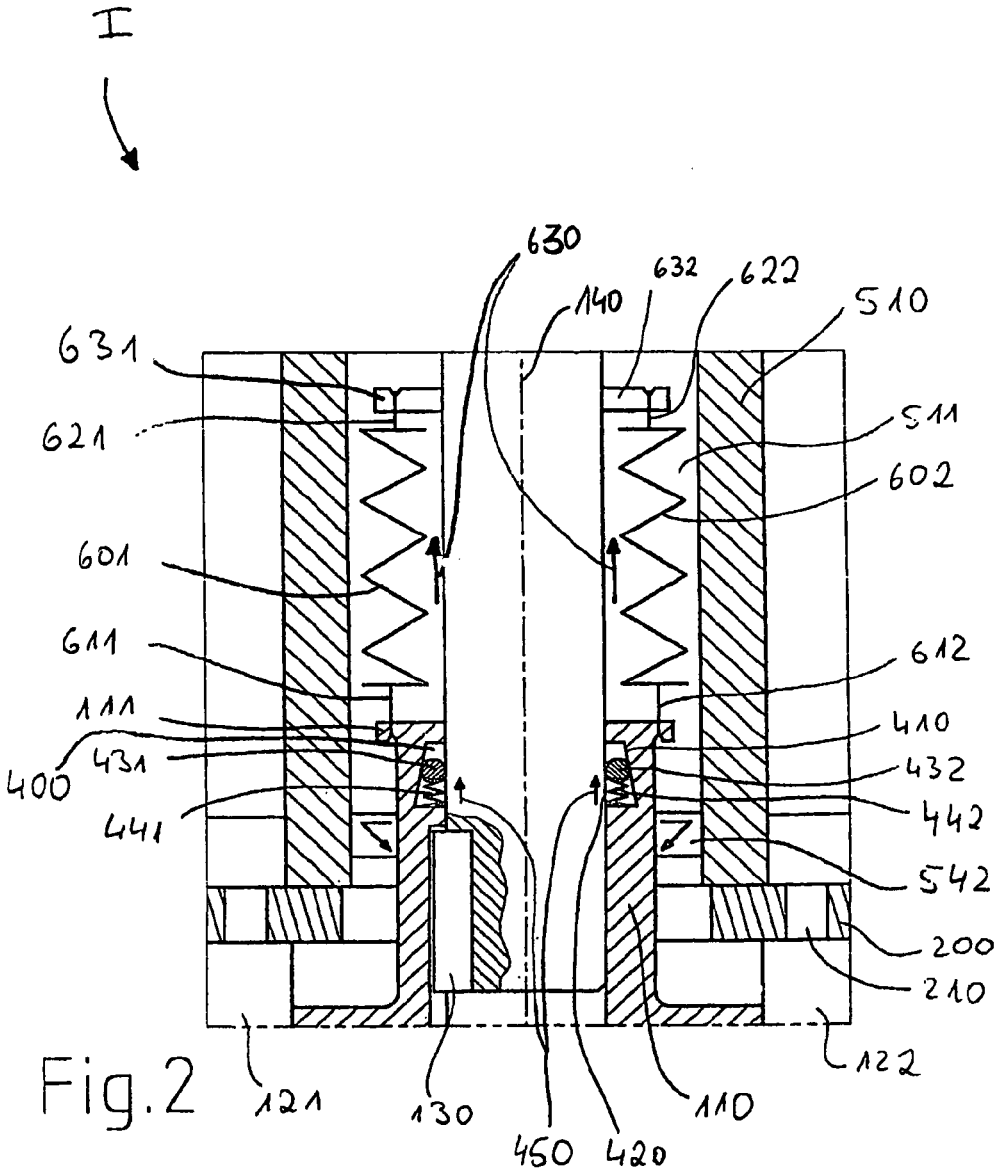
FIG. 2 shows an enlarged illustration of the detail I in FIG. 1.

The knife rotor 100 is pretensioned in a first, axial pretensioning direction 630 against the cutting sieve 200 by means of multiple extension springs. Of these, only two extension springs 601, 602 can be seen in the cutaway view in FIGS. 1 and 2. The extension springs 601, 602 are attached to the end 111 of the holder segment 110 of the knife rotor 100 by their first ends 611, 612. The extension springs 601, 602 are attached to extension spring holders 631, 632 of the drive shaft by their second ends 621, 622. The extension springs 601, 602 have a length extending from their first ends 611, 612 to their second ends 621, 622, wherein said length is relatively large in comparison to a potential wear path traveled by the knives 121, 122 of the knife rotor 100. In this way, the invention achieves a substantially constant pretensioning of the knife rotor 100 against the cutting sieve 200, even when the wear on the knives 121, 122 is advanced.

The holder segment 110 of the knife rotor 100 has a clearance space designed as a ring-shaped recess 400. The clearance space 400 has a first surface 410 constructed on the holder segment 110, and a second surface 420 which is constructed on the drive shaft 300. The first surface 410 is designed as the inner surface of a cone. The second surface is designed as the outer surface of the cylindrical drive shaft. The recess 400 is flared in the direction of the cutting sieve 200. Multiple freewheel bodies designed as spheres 430 are arranged in the clearance space 400. Of these, two freewheel bodies 431, 432 can be seen in the cross-section given in FIGS. 1 and 2.

The freewheel bodies 431, 432 are pretensioned via pressure springs 441, 442 to abut the first surface 410 and the second surface 420 in a second pretensioning direction 450. As such, it is not possible for the knife rotor 100 to move against the first pretensioning direction 630 and/or the second pretensioning direction 450, meaning away from the cutting sieve 200, due to the pretensioning of the freewheel bodies 431, 432 to abut the first surface 410 and the second surface 420. Due to the pretensioning of the freewheel bodies 431, 432 to abut the first surface 410 and the second surface 420, the advancement of the knife rotor 100 in the direction of the cutting sieve 200, meaning in the direction of the first pretensioning direction 630 and/or the second pretensioning direction 450, is not prevented.

The clearance space 400 with the freewheel bodies 431, 432 and the pressure springs 441, 442, the extension springs 601, 602 with the extension spring holders 631, 632, and a part of the holder segment 110 of the knife rotor 100 and a part of the drive shaft 300, are arranged inside the hollow cavity 511 of the hollow axle 510, and consequently are sealed by means of the shaft seal rings 541, 542 from the fluid-solid mixture channel 800. In this way, both the pretensioning mechanism for pretensioning the knife rotor 100 against the cutting sieve 200 (realized by the extension springs 601, 602 attached on the ends 111 of the holder segment 110 and the extension spring holders 631, 632), and the second pretensioning mechanism for preventing the knife rotor 100 from lifting off of the cutting sieve 200 in the direction opposite the first pretensioning direction 630 (realized by the pretensioning of the freewheel bodies 431, 432 to abut the first surface 410 and the second surface 420 of the clearance space 400) are arranged in a space which is protected from fouling.

The invention claimed is:

1. A cutting device for reducing a fluid-solid mixture, having a knife rotor which (i) is mounted so as to be able to rotate relative to a cutting sieve, (ii) abuts the cutting sieve axially with respect to the direction of its axis of rotation, and (iii) is pretensioned against the cutting sieve in a first pretensioning direction, further comprising at least one clearance space which is bounded by at least first and second surfaces, wherein the first surface is fixed with respect to the knife rotor in the axial dimension, the second surface is fixed with respect to the cutting sieve in the axial dimension, the first and the second surfaces are arranged in such a manner that the same cannot rotate about the axis of rotation of the knife rotor with respect to each other, at least one freewheel body is arranged in the at least one clearance space, and is pretensioned in the axial dimension to abut the first and the second surfaces in a second pretensioning direction, the first and the second surfaces are configured so that the radial gap between the first and the second surfaces becomes narrower in the direction of the second pretensioning direction, whereby a relative movement in the axial dimension between the knife rotor and the cutting sieve toward the first pretensioning direction is prevented.

2. A cutting device according to claim 1, wherein the first surface is constructed on a holder segment of the knife rotor and the holder segment is configured to connect the knife rotor to a drive shaft in a torsion-proof manner.

3. A cutting device according to claim 1, wherein the second surface is constructed on a drive shaft.

4. A cutting device according to claim 1, wherein either the first surface is constructed as the inner surface of a cone or as a section of an inner surface of a cone or the second surface is constructed as the outer surface of a cylinder or as a section of an outer surface of a cylinder.

5. A cutting device according to claim 1, wherein the second pretensioning direction extends in the direction of the first pretensioning direction.

6. A cutting device according to claim 1, wherein the second pretensioning direction extends opposite that of the first pretensioning direction.

7. A cutting device according to claim 1, wherein the at least one clearance space is designed as a ring-shaped recess.

8. A cutting device according to claim 1, wherein the at least one freewheel body is configured as a sphere.

9. A cutting device according to claim 1, wherein the freewheel body is pretensioned between the first and the second surfaces by means of a pressure spring.

10. A cutting device according to claim 1, wherein the knife rotor is pretensioned against the cutting sieve in such a manner that the knife rotor abuts the cutting sieve with a substantially constant pretensioning force.

11. A cutting device according to claim 1, wherein the pretension of the knife rotor against the cutting sieve is generated by means of at least one extension spring.

12. A cutting device according to claim 11, wherein the at least one extension spring has a length larger than a wear path traveled by the knife rotor.

13. A cutting device according to claim 11, wherein the at least one extension spring is connected via a first end thereof to the knife rotor, and via a second end thereof to a drive shaft.

14. A cutting device according to claim 1, wherein the at least one clearance space is arranged in the hollow cavity of a hollow axle.

15. A cutting device according to claim 1, wherein:

a. a holder segment of the knife rotor is connected in a torsion-proof manner to a drive shaft via a feather key, wherein the drive shaft is mounted in a fixed hollow axle which cannot be displaced in the axial dimension and which is coupled to the cutting sieve, the drive shaft being mounted thereto in a rotatable manner and in a manner such that the same cannot be displaced in the axial dimension, and the drive shaft is designed to drive the rotation of the knife rotor, b. the at least one clearance space is configured as a ring-shaped recess in the holder segment of the knife rotor which is coaxial with the drive shaft, wherein the first surface is constructed as the inner surface of a cone on the holder segment of the knife rotor and the second surface is constructed as an outer surface of the drive shaft, c. the axial gap between the first and the second surfaces becomes narrower in the direction approaching the cutting sieve, d. the at least one freewheel body is pretensioned by means of at least one pressure spring, e. the knife rotor is pretensioned against the cutting sieve by at least one extension spring, f. the clearance space, the at least one extension spring, and at least one segment of the drive shaft are arranged in the hollow space of the hollow axle, and g. the extension spring has length larger than a wear path traveled by the knife rotor.

* * * * *